US010692317B2

(12) United States Patent
Oberbeckmann et al.

(10) Patent No.: US 10,692,317 B2
(45) Date of Patent: Jun. 23, 2020

(54) VEHICLE DOOR PULL COMPRISING AN ANTENNA ARRANGEMENT

(71) Applicant: HUF HÜLSBECK & FÜRST GMBH & CO. KG, Velbert (DE)

(72) Inventors: Kai Oberbeckmann, Wuppertal (DE); Joerg Simon, Wuelfrath (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 0 days.

(21) Appl. No.: 15/767,305

(22) PCT Filed: Sep. 26, 2016

(86) PCT No.: PCT/EP2016/072820

§ 371 (c)(1),
(2) Date: Apr. 10, 2018

(87) PCT Pub. No.: WO2017/080710

PCT Pub. Date: May 18, 2017

(65) Prior Publication Data

US 2018/0300975 A1 Oct. 18, 2018

(30) Foreign Application Priority Data

Nov. 11, 2015 (DE) ..... 10 2015 119 476

(51) Int. Cl.
*H01Q 1/32* (2006.01)
*G07C 9/00* (2020.01)
(Continued)

(52) U.S. Cl.
CPC ..... *G07C 9/00309* (2013.01); *E05B 81/76* (2013.01); *E05B 85/16* (2013.01); *H01Q 1/3241* (2013.01); *H01Q 1/3283* (2013.01)

(58) Field of Classification Search
CPC .. H01Q 1/3283; H01Q 1/3241; H01Q 1/3291; G07C 9/00309; E05B 85/16; E05B 81/76
See application file for complete search history.

(56) References Cited

U.S. PATENT DOCUMENTS 6,577,228 B1 * 6/2003 Tsuchida ..... B60R 25/24 340/10.1
2003/0001729 A1 * 1/2003 Ieda ..... B60R 25/246 340/426.1

(Continued)

FOREIGN PATENT DOCUMENTS

CN 203085744 U 7/2013
DE 602 23 405 T2 8/2008

(Continued)

OTHER PUBLICATIONS

International Preliminary Report on Patentability (and English translation) of International Application No. PCT/EP2016/072820 dated May 15, 2018, 25 pages.

(Continued)

*Primary Examiner* — Awat M Salih
(74) *Attorney, Agent, or Firm* — Fay Sharpe LLP

(57) ABSTRACT

A vehicle door handle includes a handle and a handle mount, wherein the handle is mounted in the handle mount. The handle is formed as an elongated body which has first and second end sections and a grip section disposed in the middle of the handle between the end sections. Bearing sections of the first and second end sections extend into the handle mount and are supported therein. An antenna with a control circuitry is a disposed in an inner hollow chamber in the handle. The control circuitry has signal lines which go to the handle mount. The antenna is configured as a high frequency antenna for signal transmission in the high frequency range. The control circuitry is coupled to the antenna (Continued)

for transmitting and receiving. The antenna is received outside the grip section in an end section of the handle.

10 Claims, 1 Drawing Sheet

(51) Int. Cl.
*E05B 81/76* (2014.01)
*E05B 85/16* (2014.01)

(56) References Cited

U.S. PATENT DOCUMENTS

2003/0063037 A1* 4/2003 March ..... H01Q 1/3241 343/711
2006/0232484 A1 10/2006 Wulff et al.
2008/0068129 A1* 3/2008 Ieda ..... B60R 25/246 340/5.72
2011/0140479 A1* 6/2011 Okada ..... E05B 81/78 296/146.1
2012/0133563 A1* 5/2012 Naka ..... E05B 81/77 343/713
2016/0028148 A1* 1/2016 Tan ..... H01Q 1/48 343/702
2018/0002954 A1* 1/2018 Uemura ..... E05B 85/16

FOREIGN PATENT DOCUMENTS

DE 10 2013 112 276 A1 5/2015
EP 1 083 280 A2 3/2001
EP 1 533 450 A1 5/2005
EP 2 772 986 A1 9/2014

OTHER PUBLICATIONS

International Search Report of International Application No. PCT/EP2016/072820 dated Jan. 3, 2017, 5 pages.

* cited by examiner

VEHICLE DOOR PULL COMPRISING AN ANTENNA ARRANGEMENT

The invention relates to a vehicle door handle with an antenna assembly.

BACKGROUND

In particular, the invention relates to a vehicle door handle that is to be installed on a motor vehicle, wherein the vehicle door handle has a handle and a handle mount, wherein the handle is mounted in the handle mount. Such a vehicle door handle assembly is installed on a vehicle door in that the handle mount is placed on the inner surface of a door panel, thus on the side facing the vehicle interior, while the handle is disposed on the outer surface of the panel, such that it can be actuated by the user. In this manner, the door panel lies between the handle and the handle mount. Projections on the handle extend through holes in the door panel, and are coupled to the handle mount.

The handle is in the form of an elongated body, wherein bearing sections are formed at both longitudinal end sections of the handle. Depending on the design of the door handle, as either a stationary door handle or as a pivotal door handle, the bearing sections are coupled to the handle mount in either a stationary or moving manner.

A grip section is formed in a middle section of the handle, such that it can be gripped by a user.

With a stationary door handle, the bearing sections are coupled in a stationary manner to the handle mount. This coupling is obtained in the initial installation and the door handle interacts with an electrically actuated latch (e-latch). The handle then serves in particular as an access possibility for opening the door, and may contain electronic sensors and other components that release the electric door latch when a user grasps the door handle.

With a pivotal door handle, on the contrary, one end section of the handle is configured as the actuating section, with an associated bearing section. In a second end section along the longitudinal alignment of the handle of the pivotal door handle, a pivotal section is formed with the associated bearing section. The pivotal section and the actuating section are accordingly disposed on opposite longitudinal ends of the handle.

The actuating section of a pivotal handle is referred to in the present application as such because it extends with its bearing section into the handle mount, and interacts mechanically with actuating means there, to transfer a movement of the handle to the actuating means. This section can thus move when a user grasps or reaches behind the grip section and exerts a pulling force. The actuating section is then deflected, and the associated bearing section actuates the actuating means in the handle mount.

The pivotal section is formed on the other end of the handle in a pivotal door handle. The bearing section of this pivotal section is received in a pivot bearing of the handle mount, such that the handle can be pivoted when the user pulls on the grip section in a guided movement through interaction of the bearing section of the pivotal section and the pivot bearing. The handle is thus pivoted in one direction in a pivot bearing, and thus deflected at the other, distal end from the pivotal section (the actuating section), to actuate the actuating means in the handle mount.

Regardless of the type of door handle, thus with both stationary door handles as well as with pivotal door handles, at least one antenna with a control circuitry is disposed in the handle itself, wherein the control circuitry includes signal lines, which pass through the handle to the handle mount. Electromagnetic signals can be transmitted via the antenna in the handle.

Vehicle door handles of this type are known in the field. By way of example, a generic vehicle door handle device is known from EP 2 772 986 A1.

The antennas disposed in the vehicle door handle are frequently low-frequency antennas, which transmit trigger or waking signals to electronic vehicle keys for so-called keyless entry systems. There is, however, an increasing desire for more complex communication in motor vehicles.

The object of the invention is to improve the functionality of a vehicle door handle.

BRIEF SUMMARY

This problem is solved by a vehicle door handle that has the features of claim 1.

In accordance with the invention, the vehicle door handle of the type specified in the introduction has a high-frequency antenna in the interior of the handle, configured to transmit signals in the high-frequency range. The control circuitry is configured as a transceiver circuit for bidirectional operation, thus as a transmitter and receiver, using the same high-frequency antenna.

In accordance with the invention, the high-frequency antenna is disposed inside the handle, not in the grip section.

As explained above, the handle in every door handle of this type, regardless of whether it is a stationary or pivotal handle, has two end sections, each of which has associated bearing sections. The grip section is disposed therebetween. The grip section is defined by the accessibility and operability for a user. Accordingly, the grip section is that section that can be grasped, or reached behind. This is the case, in particular, in which there is enough space between the handle and the door panel (or handle mount), because there must be a spacing of at least 3 cm between the handle and the door panel in order to be able to reach behind it comfortably. Accordingly, the grip section is at a spacing to the handle mount, providing space for the hand or fingers of a user. In contrast thereto, it is not possible to reach behind the end sections. They are flush with the vehicle panel or the underlying handle mount, and are even coupled to the handle mount without spacing in the regions of the bearing sections. According to the invention, the high-frequency antenna is thus received in the end sections, not within the grip section. The precise transition from the end sections to the grip section is determined by the respective design of the door handle. According to this application, an end section ends where a user can grasp the handle and actuate it.

The invention takes into account the fact that the shielding of the high-frequency antenna field by the hand or other body parts of the user is disruptive. In accordance with the invention, the antennas are therefore disposed in the handle outside the grip section. This is the section where a shielding by the hand of a user grasping the grip section is least probable.

When disposed in this region, the transmitting antenna and the receiving antenna can be operated with low risk of disruption by the effects of the body tissues of a user. The antennas can be fully received in an end section, outside the grip section, such that at least most of the antenna is not disposed within the grip section.

The antennas can be formed outside the grip section and within an end section entirely in part of the handle lying outside the door panel, but they can also be formed, at least in part, in the part of the handle extending through the holes in the door panel, thus formed in the bearing sections of the end sections. The handle has bearing sections in accordance with the description above, which extend through the door panel. Accordingly, there is no door panel material in this region, and the antenna assembly can be accommodated in a bearing section of the end section.

In a preferred embodiment of the invention, the door handle has a pivotal handle in accordance with the description above, and the antenna is received in the pivotal section of the handle. As described above, with door handles that have pivotal handles, the handle has at least one actuating section in the form of a section running along its longitudinal direction, a grip section, and a pivotal section. The mechanical actuation and exertion of force on the actuating means in the handle mount takes place at the actuating section through the transfer of force from a pulling movement exerted by a user in the region of the grip section.

A covering by the hand of a user grasping the grip section is least probable in the pivotal section. Vehicle door handles with pivotal handles are normally designed with the grip section aligned such that it closer to the actuating section than to the pivotal section, to improve the leverage and accessibility. A user grasping the grip section in the comfortable region would thus place his hand closer to the actuating section than to the pivotal section. This applies in general, and substantially independently of the concrete design of the door handle. Specifically for an optimal transfer of force, it is important that the grasping of the user can take place a far as possible from the pivot axis, and a close as possible to the actuating section.

With most door handles, the transitions between the pivotal section and the grip section are smooth, but it is essential to the invention that the antenna is at least mostly received in the pivotal section. The antenna is thus received in any case in that half of the handle that forms the pivotal section of the end section.

In a preferred embodiment of the invention, the antenna is configured for signal transmission in a frequency in the range of 2 GHz to 5 GHz. This range contains, in particular, the frequencies of the so-called ISM band, in which, in particular, Bluetooth communication takes place. The transmission according to the Bluetooth standard by both the antenna as well as by the control circuitry to the antenna is a particularly preferred embodiment of the invention.

It is particularly preferred that the antenna is disposed on a printed circuit board in the form of a conductor path. The vehicle door handle can contain further electronic components, which can be disposed on the same printed circuit board. It is essential, however, that a printed circuit board section containing the antenna is disposed in the pivotal section of the door handle. The antenna can also be disposed together with the control circuitry on the same printed circuit board, wherein it is essential in this case, that the printed circuit board is oriented and disposed in the handle, such that the antenna is disposed on an end of the printed circuit board facing away from the grip section, such that a maximum spacing to the grip section is obtained.

It is particularly preferred that the pivotal section is designed as an extension of the grip section of the handle, and the pivotal section is formed by a section of the handle that is less than 30% of the overall length of the handle, preferably less than 20% of the overall length thereof.

The pivotal section thus represents no more than 30% of the length of the handle, and is defined as a region that is never grasped by a user in the normal operation thereof. The region in this section between the door panel and the handle is normally so small that it is impossible for a user to reach behind it.

It is preferred that the vehicle door handle is designed such that the spacing between the handle and the handle mount in the entire grip section is greater than in the actuating section and in the pivotal section.

The grip section is thus defined as that middle section of the handle that has a greater spacing to the handle mount throughout than the end sections. The grip section is preferably defined such that the spacing between the handle mount and the handle is at least 3 cm. The remaining sections of the handle then form the actuating section at one end, and the pivotal section at the other end.

BRIEF DESCRIPTION OF THE DRAWINGS

The invention shall now be described based on the accompanying figures.

FIG. 1*a* schematically shows a first exemplary embodiment of the invention in a standby position in;

DETAILED DESCRIPTION

Figure 1A:
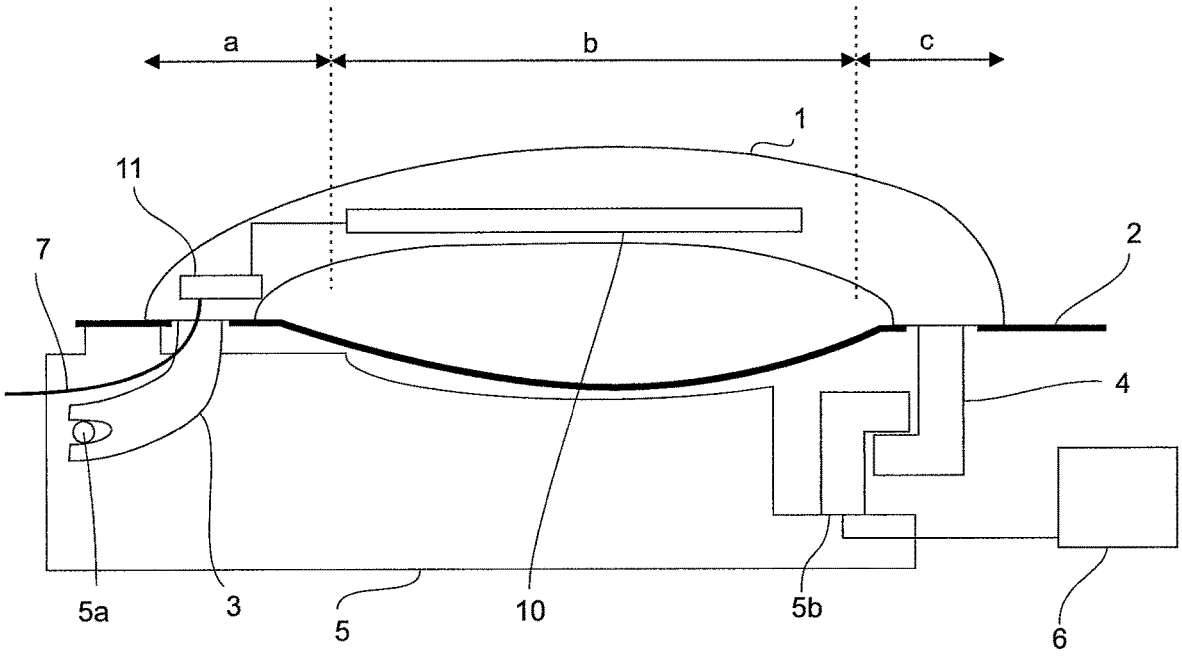

A handle 1 of a motor vehicle door handle is shown in FIG. 1*a*. In this exemplary embodiment, the motor vehicle door handle has a pivotal handle. The handle 1 bears on a vehicle door panel 2 in the depicted, installed state. A bearing section 3 formed as a pivot projection and a bearing section 4 formed as an actuating projection extend through the door panel to the inner surface of the door. The handle mount 5 is disposed on the inner surface of the door, of which the pivot bearing 5*a* and the actuating means 5*b* are shown here. The actuating means 5*b* are electrically or mechanically connected to the a latch mechanism 6 that allows the door to be opened.

The handle is divided into sections a, b and c in FIG. 1*a*. Section b represents the grip section that can be grasped by a user for actuating the handle. The section c is the actuating section, which is connected in a fixed manner to the actuating projection 4. This section c conducts the forces exerted on the handle in the region of the grip section b to the actuating means 5*b*.

Section a is the pivotal section. A part of the pivotal section a is formed as the pivot projection 3. The pivot projection 3 passes through a hole in the door panel 2, and rests in the bearing 5*a* of the handle mount. The entire handle can thus pivot about a pivotal axis, wherein this axis runs through the bearing 5*a*. With such a pivotal movement, section c of the handle and the actuating projection 4 are deflected.

A control circuitry 10 is disposed in the interior of the handle 1, which is coupled to a high-frequency antenna 11 for bidirectional communication. The antenna 11 and the control circuitry 10 form a transceiver for high-frequency communication, in the range of 2.4 GHz in this example, for a Bluetooth connection. A cable harness 7 with a supply voltage and signal lines extends out of the handle 1 in the region of the pivot bearing 5*a* to the handle mount 5. The antenna 11 forms a separate module in this exemplary embodiment, which is separate from the control circuitry 10. It is, however, possible, depending on the design of the handle, to integrate the control circuitry 10 together with the antenna 11 on a printed circuit board, or to provide numerous electronic modules, one of which is a module with the high-frequency antenna and is disposed in the pivotal region (low-frequency antennas or sensor assemblies can also be provided, for example).

In the illustration, the high-frequency antenna 11 is entirely received in the pivotal section a of the handle 1. An effect thereon, or a grasping thereof, by a user is improbable in this region, thus improving the efficacy of the transmission/reception communication.

Figure 1B:
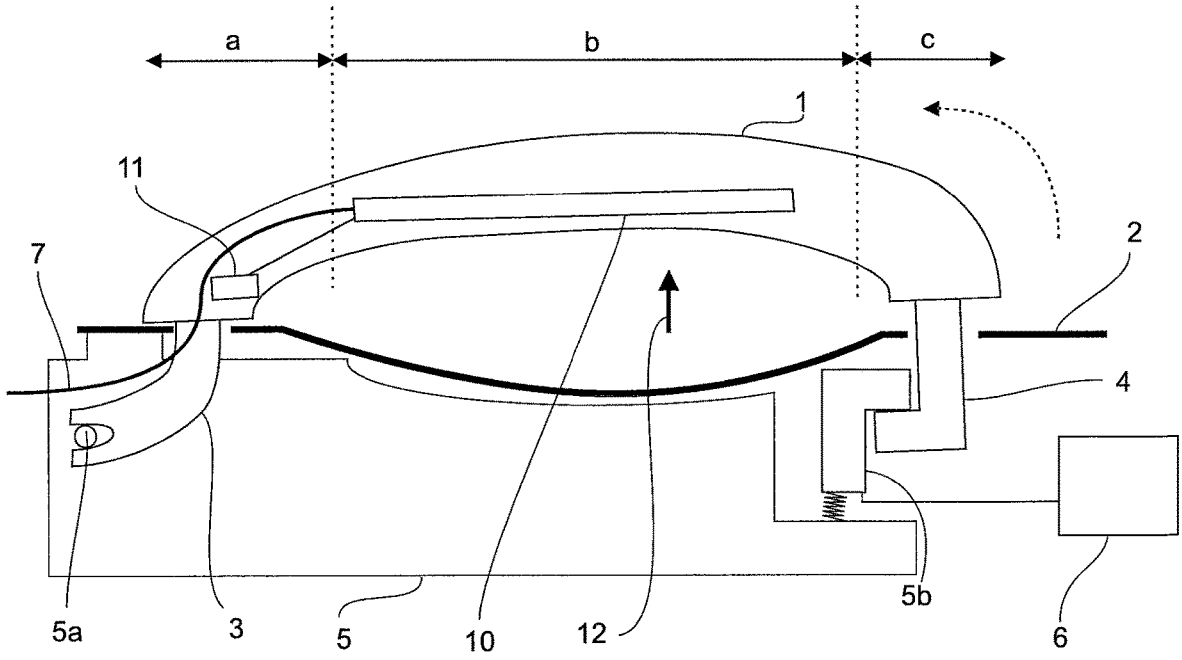
FIG. 1*b* shows the exemplary embodiment from FIG. 1*a* in an actuated position.

FIG. 1*b* shows an actuation situation, wherein the handle 1 is pivoted about an axis passing through the pivot bearing 5*a*, caused by the effects of a force applied in the direction of the arrow 12. The actuating means 5*b* are deflected by the actuating projection 4, and this deflection is transferred to the latch mechanism 6. It is clear that simply the effective leverages would cause the user, at least after he has become familiar with the door handle assembly, to regularly select a gripping location on the handle that is closer to the actuating section c than to the pivotal section a. This facilitates the operation thereof by reducing the forces necessary for this. The antenna 11 is then located at the position in the handle that is least disrupted, because there is very little risk that a user will grasp the handle there.

As described above, the configurations and orientations of the antennas in the pivotal section can fundamentally vary significantly. In the example shown here, it would also be possible to allow the antenna to extend in part into the pivot projection 3*a*. It is likewise possible to also fully receive the control device in the pivot projection a, e.g. when a printed circuit board that has both an antenna attached thereto as well as a control device, is inserted in a compact manner in the pivotal section a.

The invention claimed is:

1. A vehicle door handle that is to be installed on a motor vehicle, wherein the vehicle door handle includes a handle and a handle mount, wherein the handle is mounted in the handle mount, wherein the handle is formed as an elongated body that has a first end section and a second end section, and a grip section disposed between the end sections in a middle section of the handle, wherein the first end section and the second end section each have bearing sections, wherein the bearing sections of the first end section and the second end section extend into the handle mount and are supported therein, wherein an antenna with a control circuitry is disposed in an inner hollow chamber in the handle, and wherein the control circuitry has signal lines, which go to the handle mount, wherein the antenna is configured as a high-frequency antenna for signal transmission in the high-frequency range, and the control circuitry is coupled to the antenna for transmitting and receiving, wherein the antenna is received outside the grip section in an end section of the handle so that the antenna is located in a section of the handle where a shielding of the antenna by a hand of a user grasping the grip section of the handle is unlikely to occur.

2. The vehicle door handle according to claim 1, wherein the handle is supported in the handle mount such that it can move, wherein the first end section of the handle is configured as an actuating section, and the second end section is configured as a pivotal section, such that the pivotal section and the actuating section are disposed on opposite ends of the handle, wherein the bearing section of the actuating section extends into the handle mount and is actively connected mechanically there to actuating means, in order to transfer a movement of the handle to the actuating means, wherein the bearing section of the pivotal section is received in a pivot bearing of the handle mount, such that the handle can pivot in the pivot bearing in a movement guided by the bearing section and the pivot bearing, wherein the antenna is received in the pivotal section of the handle.

3. The vehicle door handle according to claim 1, wherein the antenna is configured for signal transmission at a frequency in the range of 2 GHz to 5 GHz.

4. The vehicle door handle according to claim 3, wherein the antenna is configured for transmission according to a Bluetooth standard.

5. The vehicle door handle according to claim 1, wherein the antenna is formed as a conductor path on a printed circuit board.

6. The vehicle door handle according to claim 5, wherein the antenna is disposed, together with the control circuitry, on the same printed circuit board.

7. The vehicle door handle according to claim 1, wherein the antenna is formed as a separate component at a spacing to the control circuitry.

8. The vehicle door handle according to claim 1, wherein the end sections are formed as integral extensions of the grip section, wherein each end section is formed by a section of the handle that has a length of less than 30% of the overall length of the handle.

9. The vehicle door handle according to claim 8 wherein each end is formed by a section of the handle that has a length of less than 20% of the overall length of the handle.

10. The vehicle door handle according to claim 1, wherein the spacing between the handle and the handle mount over the entire grip section is greater than in the end sections.

* * * * *